US008759659B2

(12) United States Patent
Tabata

(10) Patent No.: US 8,759,659 B2
(45) Date of Patent: Jun. 24, 2014

(54) MUSICAL PERFORMANCE DEVICE, METHOD FOR CONTROLLING MUSICAL PERFORMANCE DEVICE AND PROGRAM STORAGE MEDIUM

(71) Applicant: Casio Computer Co., Ltd., Tokyo (JP)

(72) Inventor: Yuji Tabata, Ome (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 13/754,323

(22) Filed: Jan. 30, 2013

(65) Prior Publication Data

US 2013/0228062 A1 Sep. 5, 2013

(30) Foreign Application Priority Data

Mar. 2, 2012 (JP) ..... 2012-046952

(51) Int. Cl.
*G10H 1/18* (2006.01)

(52) U.S. Cl.
USPC ..... 84/615; 84/653

(58) Field of Classification Search
USPC ..... 84/615, 653
See application file for complete search history.

(56) References Cited

U.S. PATENT DOCUMENTS

| | | | | | |
|---|---|---|---|---|---|
| 4,341,140 | A * | 7/1982 | Ishida | 84/711 |
| 4,968,877 | A * | 11/1990 | McAvinney et al. | 250/221 |
| 5,017,770 | A * | 5/1991 | Sigalov | 250/221 |
| 5,081,896 | A * | 1/1992 | Hiyoshi et al. | 84/600 |
| 5,369,270 | A * | 11/1994 | Gurner et al. | 250/221 |
| 5,414,256 | A * | 5/1995 | Gurner et al. | 250/221 |
| 5,442,168 | A * | 8/1995 | Gurner et al. | 463/36 |
| 5,475,214 | A * | 12/1995 | DeFranco et al. | 250/221 |
| 6,028,594 | A * | 2/2000 | Inoue | 345/173 |
| 6,222,465 | B1 * | 4/2001 | Kumar et al. | 341/20 |
| RE37,654 | E * | 4/2002 | Longo | 84/626 |
| 6,388,183 | B1 * | 5/2002 | Leh | 84/645 |
| 6,492,775 | B2 * | 12/2002 | Klotz et al. | 315/120 |
| 6,960,715 | B2 * | 11/2005 | Riopelle | 84/725 |
| 7,402,743 | B2 * | 7/2008 | Clark et al. | 84/615 |
| 7,723,604 | B2 * | 5/2010 | Bang et al. | 84/615 |
| 7,799,984 | B2 * | 9/2010 | Salter | 84/477 R |
| 8,198,526 | B2 * | 6/2012 | Izen et al. | 84/743 |
| 8,477,111 | B2 * | 7/2013 | Lim | 345/173 |
| 2001/0035087 | A1 * | 11/2001 | Subotnick | 84/600 |
| 2003/0159567 | A1 * | 8/2003 | Subotnick | 84/626 |
| 2007/0000374 | A1 * | 1/2007 | Clark et al. | 84/724 |
| 2007/0256546 | A1 * | 11/2007 | Hikino et al. | 84/615 |
| 2009/0318225 | A1 * | 12/2009 | Yamaguchi et al. | 463/32 |
| 2012/0144979 | A1 * | 6/2012 | Tansley | 84/645 |

FOREIGN PATENT DOCUMENTS

| | | |
|---|---|---|
| JP | 06-301476 A | 10/1994 |
| JP | 3599115 B2 | 12/2004 |

* cited by examiner

*Primary Examiner* — David S. Warren
(74) *Attorney, Agent, or Firm* — Holtz Holtz Goodman & Chick PC

(57) ABSTRACT

An object of the present invention is to provide a musical performance device by which layout information, such as information regarding the arrangement of a virtual musical instrument set, can be quickly and easily changed during musical performance and whereby the variety of musical performance can be increased. In the present invention, a CPU identifies a musical tone associated with a virtual pad in an area where the position coordinates of a marker section are located in an image captured by a camera unit section at a shot timing by a drumstick section, and emits the identified musical tone. When the position coordinates of the marker section in an image captured at a shot timing are within the area of a control pad on a virtual plane, the CPU switches processing target set layout information to other set layout information among a plurality of set layout information.

5 Claims, 13 Drawing Sheets

MUSICAL PERFORMANCE DEVICE, METHOD FOR CONTROLLING MUSICAL PERFORMANCE DEVICE AND PROGRAM STORAGE MEDIUM

CROSS-REFERENCE TO RELATED APPLICATION

This application is based upon and claims the benefit of priority from the prior Japanese Patent Application No. 2012-046952, filed Mar. 2, 2012, the entire contents of which is incorporated herein by reference.

BACKGROUND OF THE INVENTION

1. Field of the Invention

The present invention relates to a musical performance device, a method for controlling a musical performance device and a program storage medium.

2. Description of the Related Art

Conventionally, a musical performance device has been proposed which, when a playing movement by an instrument player is detected, generates an electronic sound in response to it. For example, a musical performance device (air drums) is known that generates a percussion instrument sound using only components provided on drumsticks. In this musical performance device, when the instrument player makes a playing movement which is similar to the motion of striking a drum and in which the instrument player holds drumstick-shaped components with a built-in sensor and swings them, the sensor detects the playing movement and a percussion instrument sound is generated.

In this type of musical performance device, the sound of a musical instrument can be emitted without the actual musical instrument. Therefore, the instrument player can enjoy playing music without the limitations of a playing location or a playing space.

As this type of musical performance device, for example, Japanese Patent No. 3599115 discloses a musical instrument gaming device that captures an image of a playing movement made by the instrument player using drumstick-shaped components, displays on a monitor a composite image generated by the captured image of the playing movement and a virtual image showing a musical instrument set being combined, and emits a predetermined musical sound based on the positional information of the drumstick-shaped components and the virtual musical instrument set.

However, in the musical instrument gaming device disclosed in Japanese Patent No. 3599115, layout information, such as information regarding the arrangement of the virtual musical instrument set, has been predetermined. Therefore, if this musical instrument gaming device is used as is, the layout information cannot be changed during musical performance, and an increase in the variety of musical performance by the change of the layout information cannot be made.

Here, if a configuration is adopted in which a switch for layout setting is provided in the main body of the musical instrument gaming device and operated, the layout information in the musical instrument gaming device disclosed in Japanese Patent No. 3599115 can be changed. However, in this configuration, changing the layout information during musical performance is troublesome, time consuming and lacks practicality.

SUMMARY OF THE INVENTION

The present invention has been conceived in light of the above-described problems. An object of the present invention is to provide a musical performance device, a method for controlling a musical performance device, and a program storage medium by which layout information, such as information regarding the arrangement of a virtual musical instrument set, can be quickly and easily changed during musical performance and whereby the variety of a musical performance can be increased.

In order to achieve the above-described object, in accordance with one aspect of the present invention, there is provided a musical performance device comprising: a musical performance component which is operated by a player; a position detecting section which detects position of the musical performance component on a virtual plane where the musical performance component is operated: a selecting section which selects layout information from among plural types of layout information including a plurality of areas arranged on the virtual plane and musical tones respectively associated with the plurality of areas; a judging section which judges whether the position of the musical performance component is within one of the plurality of areas arranged based on the selected layout information, when a certain music-playing operation is performed by the musical performance component; and a sound generation instructing section which, when the judging section judges that the position of the musical performance component is within one area of the plurality of areas, gives an instruction to emit musical sound of a musical tone associated with the one area, wherein the plural types of layout information respectively include information regarding a certain area other than the plurality of areas, and wherein the selecting section selects layout information other than the currently-selected layout information from among the plural types of layout information, when the certain music-playing operation is performed by the musical performance component and the position of the musical performance component is within the certain area.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

FIG. 6 is a diagram showing a set layout information group of the musical performance device according to the embodiment of the present invention;

DETAILED DESCRIPTION OF THE PREFERRED EMBODIMENTS

An embodiment of the present invention will hereinafter be described with reference to the drawings.

[Overview of the Musical Performance Device 1]

First, an overview of the musical performance device 1 according to the embodiment of the present invention will be described with reference to FIG. 1A and FIG. 1B.

Figure 1A:
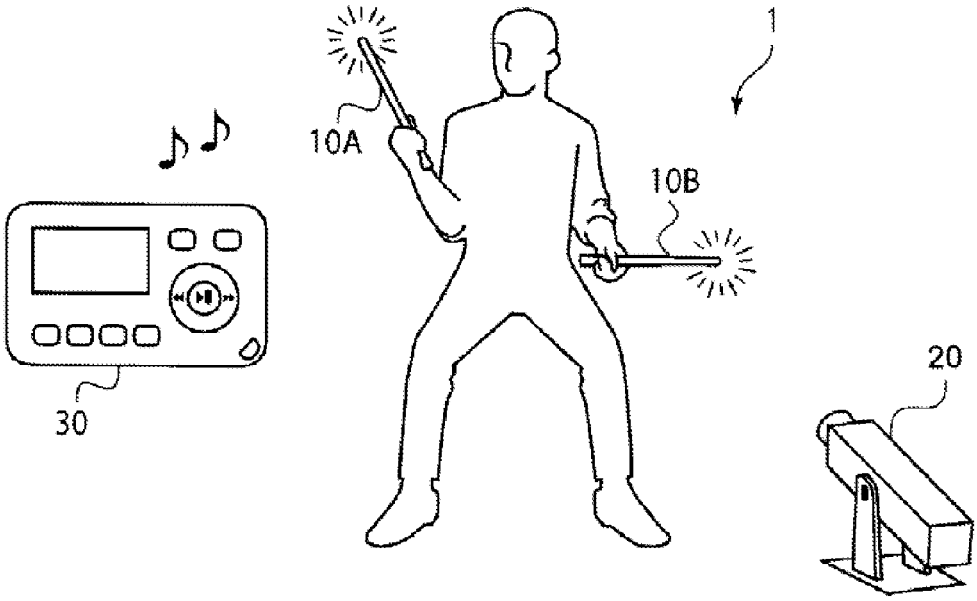
FIG. 1A and FIG. 1B are diagrams outlining a musical performance device according to an embodiment of the present invention.
Figure 1B:
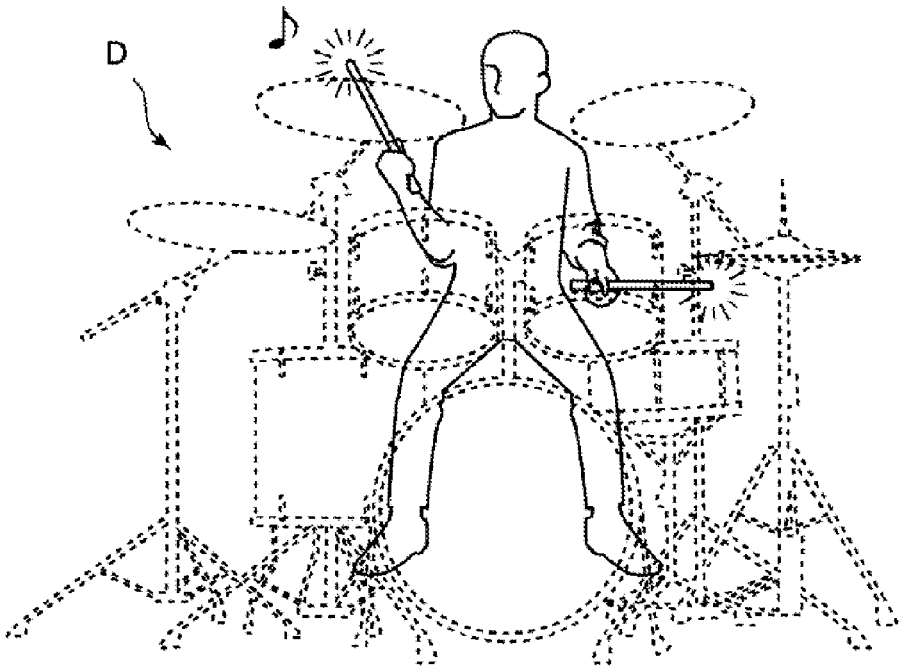

The musical performance device 1 according to the present embodiment includes drumstick sections 10A and 10B, a camera unit section 20, and a center unit section 30, as shown in FIG. 1A. Note that, although this musical performance device 1 includes two drumstick sections 10A and 10B to actualize a virtual drum performance by two drumsticks, the number of drumstick sections is not limited thereto, and the musical performance device 1 may include a single drumstick section, or three or more drumstick sections. In the following descriptions where the drumstick sections 10A and 10B are not required to be differentiated, these two drumstick sections 10A and 10B are collectively referred to as "drumstick section 10".

The drumstick section 10 is a drumstick-shaped musical performance component that extends in a longitudinal direction. The instrument player holds one end (base end side) of the drumstick section 10 and makes, as a playing movement, a movement in which the drumstick section 10 is swung upwards and downwards with his or her wrist or the like as a fulcrum. In the other end (tip end side) of the drumstick section 10, various sensors such as an acceleration sensor and an angular velocity sensor (motion sensor section 14, described hereafter) are provided to detect this playing movement by the instrument player. The drumstick section 10 transmits a note-ON event to the center unit section 30 based on a playing movement detected by these various sensors.

Also, on the tip end side of the drumstick section 10, a marker section 15 (see FIG. 2) described hereafter is provided so that the camera unit section 20 can recognize the tip of the drumstick section 10 during imaging.

The camera unit section 20 is structured as an optical imaging device. This camera unit section 20 captures a space including an instrument player who is making a playing movement with the drumstick section 10 in hand (hereinafter referred to as "imaging space") as a photographic subject at a predetermined frame rate, and outputs the captured images as moving image data. Then, it identifies the position coordinates of the marker section 15 emitting light within the imaging space, and transmits data indicating the position coordinates (hereinafter referred to as "position coordinate data") to the center unit section 30.

The center unit section 30 emits, when a note-ON event is received from the drumstick section 10, a predetermined musical sound based on the position coordinate data of the marker 15 at the time of the reception of this note-ON event. Specifically, the position coordinate data of a virtual drum set D shown in FIG. 1B has been stored in the center unit section 30 in association with the imaging space of the camera unit section 20, and the center unit section 30 identifies a musical instrument virtually struck by the drumstick section 10 based on the position coordinate data of the virtual drum set D and the position coordinate data of the marker section 15 at the time of the reception of a note-ON event, and emits a musical sound corresponding to the musical instrument.

Next, the structure of the musical performance device 1 according to the present embodiment will be described in detail.

[Structure of the Musical Performance Device 1]

First, the structure of each components of the musical performance device 1 according to the present embodiment, or more specifically, the structures of the drumstick section 10, the camera unit section 20, and the center unit section 30 will be described with reference to FIG. 2 to FIG. 5.

[Structure of the Drumstick Section 10]

Figure 2:
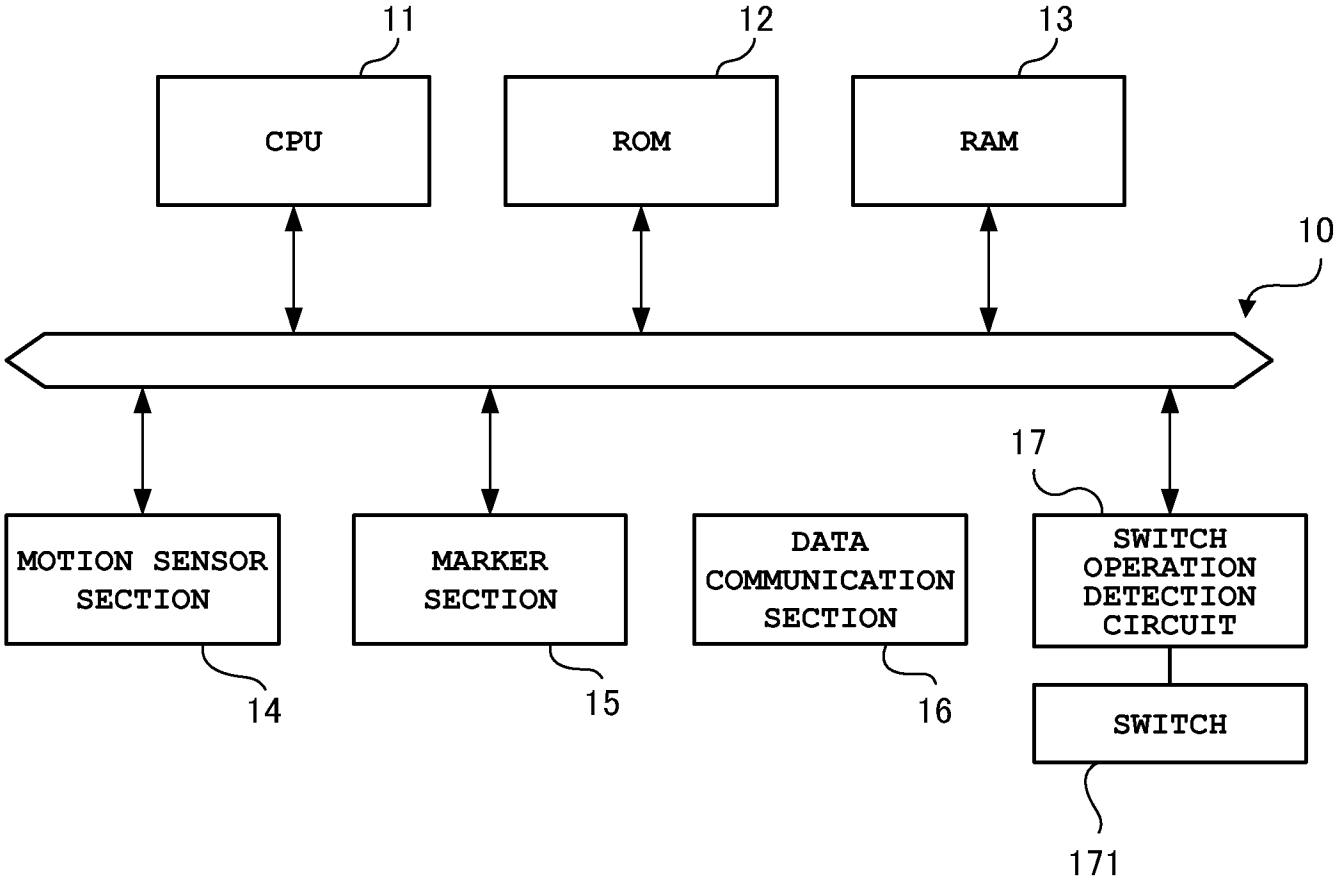
FIG. 2 is a block diagram showing the hardware structure of a drumstick section constituting the musical performance device.

FIG. 2 is a block diagram showing the hardware structure of the drumstick section 10.

The drumstick section 10 includes a Central Processing Unit (CPU) 11, a Read-Only Memory (ROM) 12, a Random Access Memory (RAM) 13, the motion sensor section 14, the marker section 15, a data communication section 16, and a switch operation detection circuit 17, as shown in FIG. 2.

The CPU 11 controls the entire drumstick section 10. For example, the CPU 11 performs the detection of the attitude of the drumstick section 10, shot detection, and action detection based on sensor values outputted from the motion sensor section 14. Also, the CPU 11 controls light-ON and light-OFF of the marker section 15. Specifically, the CPU 11 reads out marker characteristics information from the ROM 12 and performs light emission control of the marker section 15 in accordance with the marker characteristics information. Moreover, the CPU 11 controls communication with the center unit section 30, via the data communication section 16.

The ROM 12 stores processing programs that enable the CPU 11 to perform various processing and marker characteristics information that is used for light emission control of the marker section 15. Here, the camera unit section 20 is required to differentiate between the marker section 15 of the drumstick section 10A (hereinafter referred to as "first marker" when necessary) and the marker section 15 of the drumstick section 10B (hereinafter referred to as "second marker" when necessary). The marker characteristics information is information enabling the camera unit section 20 to differentiate between the first marker and the second marker. For example, shape, size, hue, saturation, luminance during light emission, or flashing speed during light emission may be used as the marker characteristics information.

The CPU 11 of the drumstick section 10A and the CPU 11 of the drumstick section 10B each read out different marker characteristics information and perform light emission control of the respective marker sections 15.

The RAM 13 stores values acquired or generated during processing, such as various sensor values outputted by the motion sensor section 14.

The motion sensor section 14 includes various sensors for detecting the status of the drumstick section 10, and outputs predetermined sensor values. Here, the sensors constituting the motion sensor section 14 are, for example, an acceleration sensor, an angular velocity sensor, and a magnetic sensor.

Figure 3:
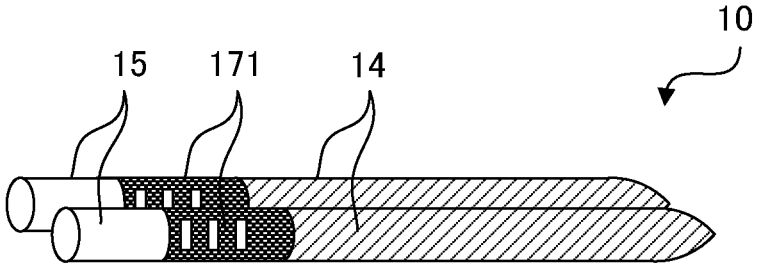
FIG. 3 is a perspective view of the drumstick section.

FIG. 3 is a perspective view of the drumstick section 10, in which a switch section 171 and the marker section 15 have been externally arranged on the drumstick section 10.

The instrument player moves the drumstick section 10 by holding one end (base end side) of the drumstick section 10 and swinging the drumstick section 10 upwards and downwards with the wrist or the like as a fulcrum, during which sensor values based on this movement are outputted from the motion sensor section 14.

When the sensor values are received from the motion sensor section 14, the CPU 11 detects the status of the drumstick section 10 that is being held by the instrument player. For example, the CPU 11 detects a timing at which the drumstick section 10 strikes the virtual musical instrument (hereinafter also referred to as "shot timing"). The shot timing denotes a time immediately before the drumstick section 10 is stopped after being swung downwards, at which the acceleration of the drumstick section 10 in the direction opposite to the downward swing direction exceeds a certain threshold value.

Figure 13:
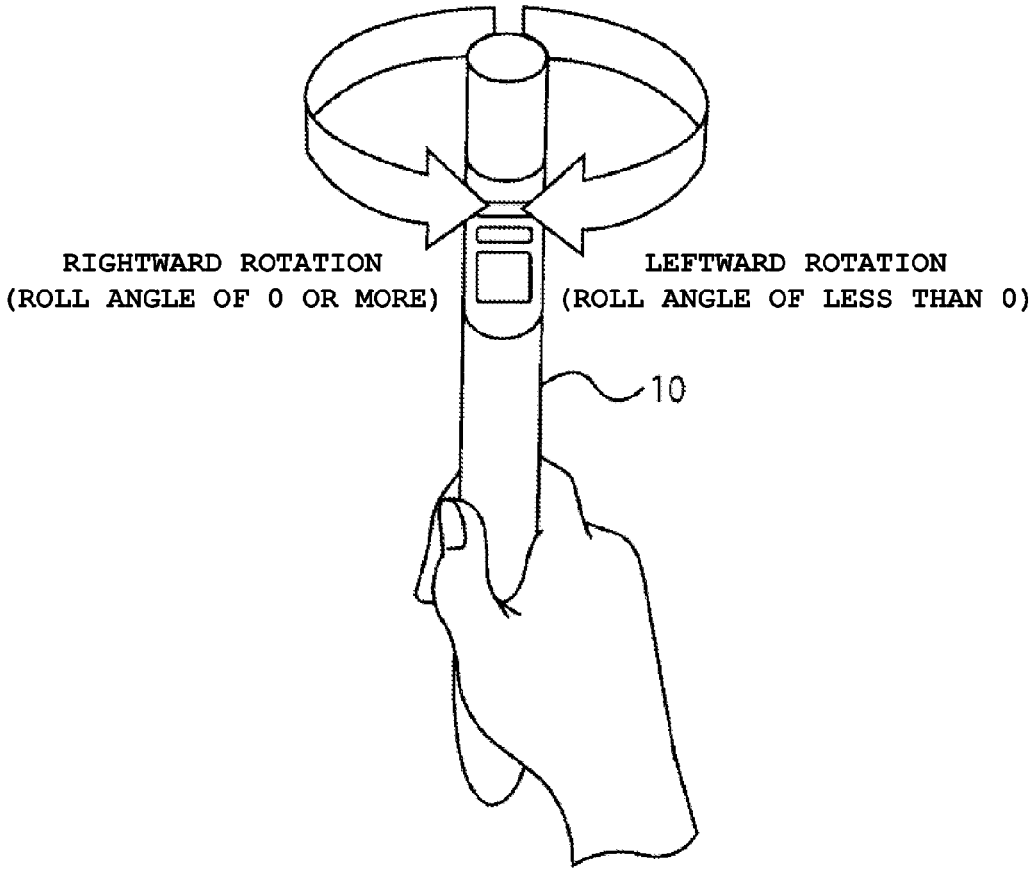
FIG. 13 is a diagram showing an example of the operation of the drumstick section.

Also, the sensor values of the motion sensor section 14 include data required to detect a "roll angle" that is a rotation angle whose axis is the longitudinal direction of the drumstick section 10 when it is held by the instrument player, as shown by the arrows in FIG. 13.

Returning to FIG. 2, the marker section 15 is a light-emitting body provided on the tip end side of the drumstick section 10, which is constituted by, for example, a light emitting diode (LED). This marker section 15 is turned ON and OFF under the control of the CPU 11. Specifically, this marker section 15 is lit based on marker characteristics information readout from the ROM 12 by the CPU 11. At this time, the marker characteristics information of the drumstick section 10A and the marker characteristics information of the drumstick section 10B differ, and therefore the camera unit section 20 can differentiate them and individually acquire the position coordinates of the marker section (first marker) 15 of the drumstick section 10A and the position coordinates of the marker section (second marker) 15 of the drumstick section 10B.

The data communication section 16 performs predetermined wireless communication with at least the center unit section 30. This predetermined wireless communication can be performed by an arbitrary method. In the present embodiment, wireless communication with the center unit section 30 is performed by infrared data communication. Note that the data communication section 16 may perform wireless communication with the camera unit section 20, or may perform wireless communication between the drumstick section 10A and the drumstick section 10B.

The switch operation detection circuit 17 is connected to the switch 171 and receives input information via the switch 171. This input information includes, for example, signal information that serves as a trigger to directly specify set layout information, described hereafter.

[Structure of the Camera Unit Section 20]

The structure of the drumstick section 10 is as described above. Next, the structure of the camera unit section 20 will be described with reference to FIG. 4.

Figure 4:
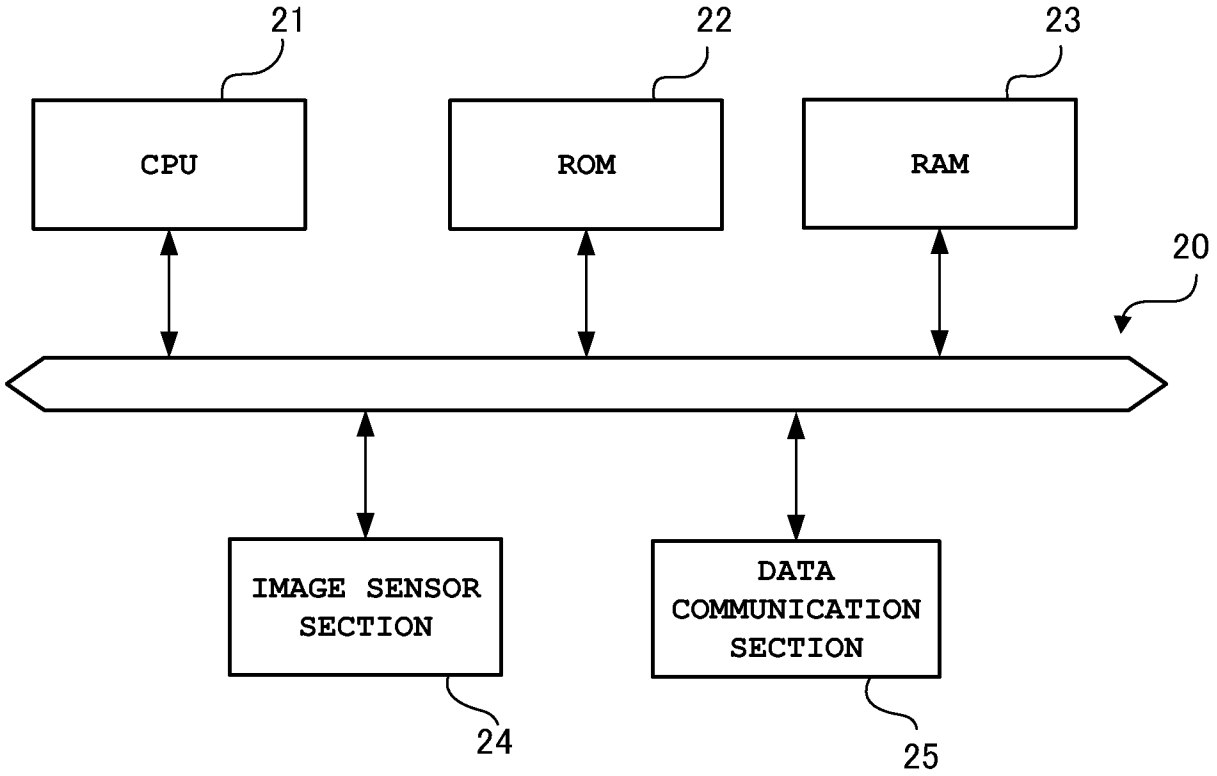
FIG. 4 is a block diagram showing the hardware structure of a camera unit section constituting the musical performance device.

FIG. 4 is a block diagram showing the hardware structure of the camera unit section 20.

The camera unit section 20 includes a CPU 21, a ROM 22, a RAM 23, an image sensor section 24, and a data communication section 25.

The CPU 21 controls the entire camera unit section 20. For example, the CPU 21 controls to calculate the respective position coordinates of the marker sections 15 (first marker and second marker) of the drumstick sections 10A and 10B based on the position coordinate data and the marker characteristics information of the marker sections 15 detected by the image sensor section 24, and output position coordinate data indicating each calculation result. Also, the CPU 21 controls communication to transmit calculated position coordinate data and the like to the center unit section 30, via the data communication section 25.

The ROM 22 stores processing programs enabling the CPU 21 to perform various processing, and the RAM 23 stores values acquired or generated during processing, such as the position coordinate data of the marker section 15 detected by the image sensor section 24. The RAM 23 also stores the respective marker characteristics information of the drumstick sections 10A and 10B received from the center unit section 30.

The image sensor section 24 is, for example, an optical camera, and captures a moving image of the instrument player who is performing a playing movement with the drumstick section 10 in hand, at a predetermined frame rate. In addition, the image sensor section 24 outputs captured image data to the CPU 21 per frame. Note that the identification of the position coordinates of the marker section 15 of the drumstick section 10 within a captured image may be performed by the image sensor section 24, or it may be performed by the CPU 21. Similarly, the identification of the marker characteristics information of the captured marker section 15 may be performed by the image sensor section 24, or it may be performed by the CPU 21.

The data communication section 25 performs predetermined wireless communication (such as infrared data communication) with at least the center unit section 30. Note that the data communication section 25 may perform wireless communication with the drumstick section 10.

[Structure of the Center Unit Section 30]

The structure of the camera unit section 20 is as described above. Next, the structure of the center unit section 30 will be described with reference to FIG. 5.

Figure 5:
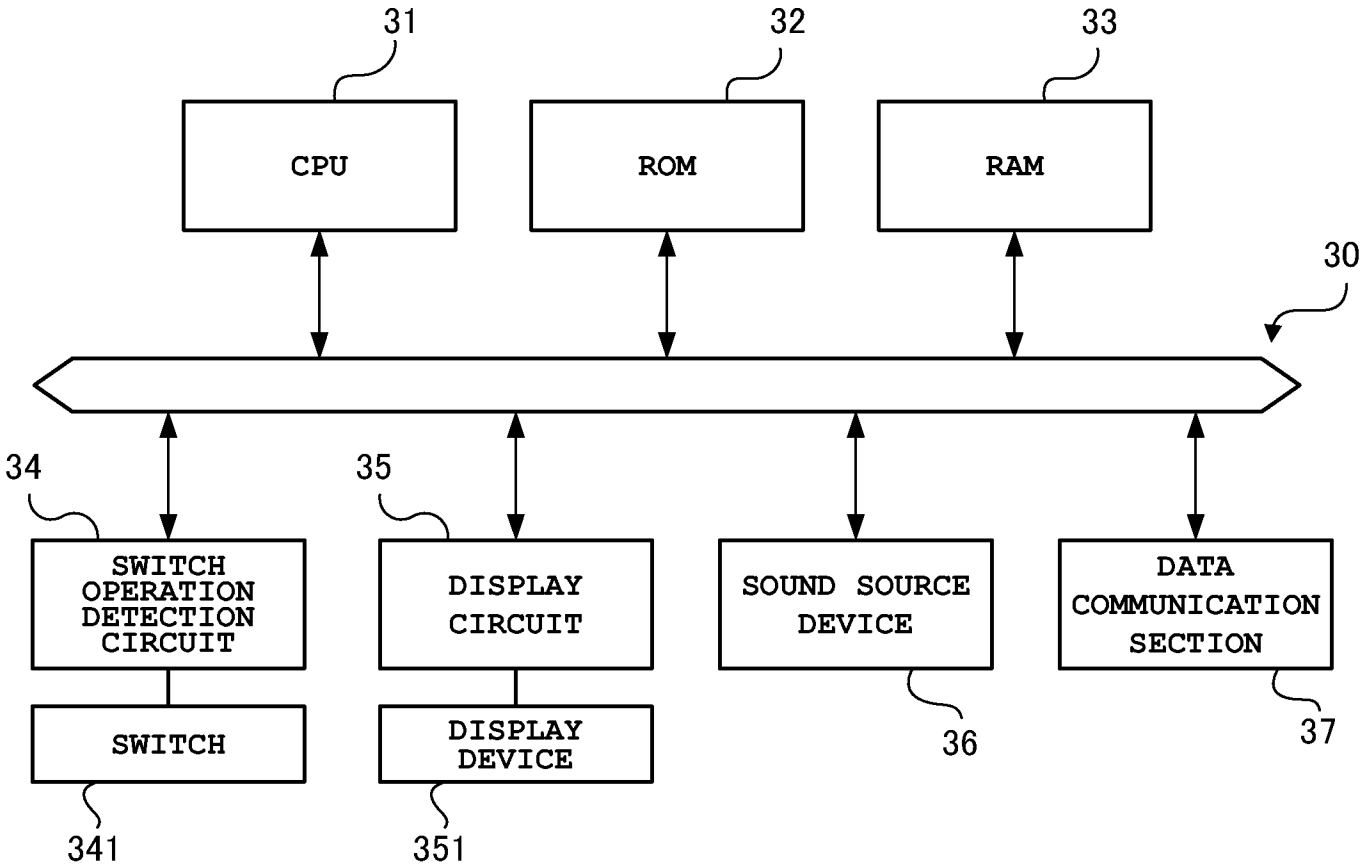
FIG. 5 is a block diagram showing the hardware structure of a center unit section constituting the musical performance device.

FIG. 5 is a block diagram showing the hardware structure of the center unit section 30.

The center unit section 30 includes a CPU 31, a ROM 32, a RAN 33, a switch operation detection circuit 34, a display circuit 35, a sound source device 36, and a data communication section 37.

The CPU 31 controls the entire center unit section 30. For example, the CPU 31 controls to emit a predetermined musical sound or the like based on a shot detection result received from the drumstick section 10 and the position coordinates of the marker section 15 received from the camera unit section 20. Also, the CPU 31 controls communication between the drumstick section 10 and the camera unit section 20, via the data communication section 37.

The ROM 32 stores processing programs for various processing that are performed by the CPU 31. In addition, the ROM 32 stores waveform data of various musical tones, such as waveform data (musical tone data) of wind instruments like the flute, saxophone, and trumpet, keyboard instruments like the piano, string instruments like the guitar, and percussion instruments like the bass drum, high-hat, snare drum, cymbal, and tom-tom, in association with position coordinates.

In a method for storing these musical tone data, n-pieces of pad information for first to n-th pads are stored in association with each piece of set layout information, as exemplified by a first set layout in a set layout information group in FIG. 6. In addition, the presence of a pad (the presence of a virtual pad on a virtual plane described hereafter), the position (position coordinates on the virtual plane described hereafter), the size (shape, diameter, and the like of the virtual pad), the musical tone (waveform data) and the like are stored in association with each piece of pad information.

Also, there are plural types of set layout information indicating the arrangement and musical tones of a plurality of virtual pads, and they are identified by set layout numbers. In the example of FIG. 6, set layout numbers "1" to "n" have been respectively given to the first to n-th set layouts.

Figure 7:
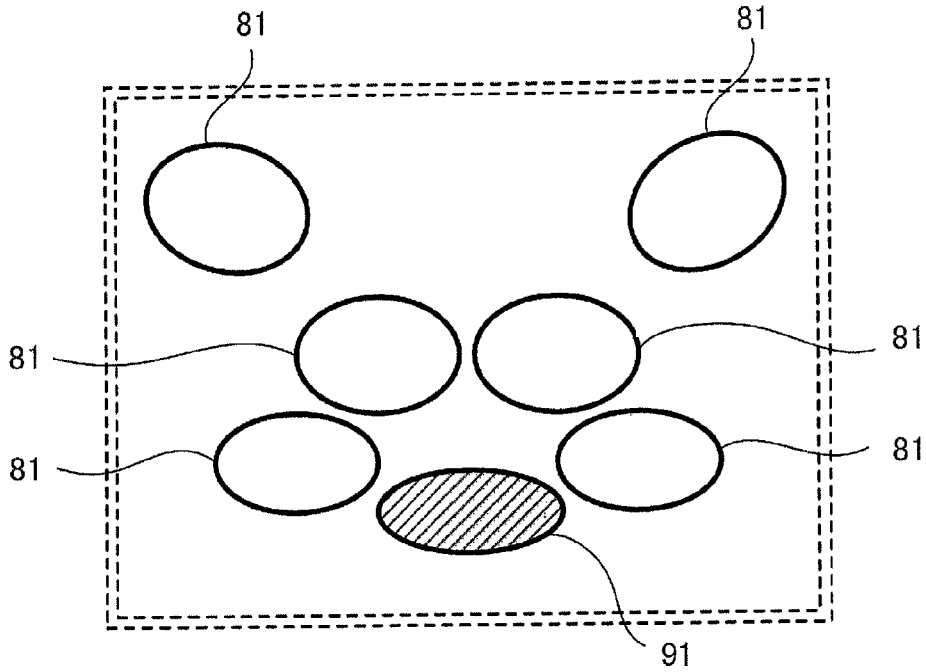
FIG. 7 is a diagram showing a concept indicated by a piece of set layout information in the set layout information group, in which the concept has been visualized on a virtual plane.

Here, a specific set layout will be described with reference to FIG. 7. FIG. 7 is a diagram showing a concept indicated by a piece of set layout information (such as the first set layout) in the set layout information group stored in the ROM 32 of the center unit section 30, in which the concept has been visualized on a virtual plane.

In FIG. 7, six virtual pads 81 have been arranged on a virtual plane. These virtual pads 81 correspond to, among the first to n-th pads, pads whose pad presence data indicates "pad present". For example, six pads, which are a second pad, a third pad, a fifth pad, a sixth pad, an eighth pad, and a ninth pad, correspond to the virtual pads 81. Also, these virtual pads 81 have been arranged based on positional data and size data, and each of which has been associated with musical tone data. Therefore, when the position coordinates of the marker section 15 at the time of shot detection are within an area corresponding to a virtual pad 81, the musical tone associated with the virtual pad 81 is emitted.

Also, in FIG. 7, a control pad 91 has been placed on the virtual plane. This control pad 91 is a virtual pad that serves as a trigger to change set layout information, which is arranged in a predetermined area on the virtual plane. For example, when the position coordinates of the marker section 15 at the time of shot detection are within the area corresponding to the control pad 91, the current set layout number is incremented (or decremented) by 1. The details thereof will be described hereafter with reference to FIG. 11.

Note that the CPU 31 may display the virtual plane and the arrangement of the virtual pads 81 and the control pad 91 on a display device 351 described hereafter.

Returning to FIG. 5, the RAM 33 stores values acquired or generated during processing, such as the status of the drumstick section 10 received from the drumstick section 10 (such as shot detection), the position coordinates of the marker section 15 received from the camera unit section 20, and a piece of set layout information read out from the ROM 32 (set layout information corresponding to a selected set layout number).

The CPU 31 read out musical tone data (waveform data) associated with a virtual pad 81 in an area where the position coordinates of the marker section 15 are located at the time of shot detection (or in other words, when a note-ON event is received), from set layout information stored in the RAM 33. As a result, a musical sound based on a playing movement by the instrument player is emitted.

The switch operation detection circuit 34 is connected to a switch 341 and receives input information via the switch 341. The input information includes, for example, information regarding changes in the sound volume and the musical tone of a musical sound to be emitted, information regarding the setting and change of a set layout number, and information regarding switching of display by the display device 351.

The display circuit 35 is connected to the display device 351 and performs display control for the display device 351.

The sound source device 36 reads out waveform data from the ROM 32 in accordance with an instruction from the CPU 31, and after generating musical sound data, converts it to an analog signal, and emits the musical sound from a speaker (not shown).

The data communication section 37 performs predetermined wireless communication (such as infrared data communication) between the drumstick section 10 and the camera unit section 20.

[Processing by the Musical Performance Device 1]

The structures of the drumstick section 10, the camera unit section 20, and the center unit section 30 constituting the musical performance device 1 are as described above. Next, processing by the musical performance device 1 will be described with reference to FIG. 8 to FIG. 11.

[Processing by the Drumstick Section 10]

Figure 8:
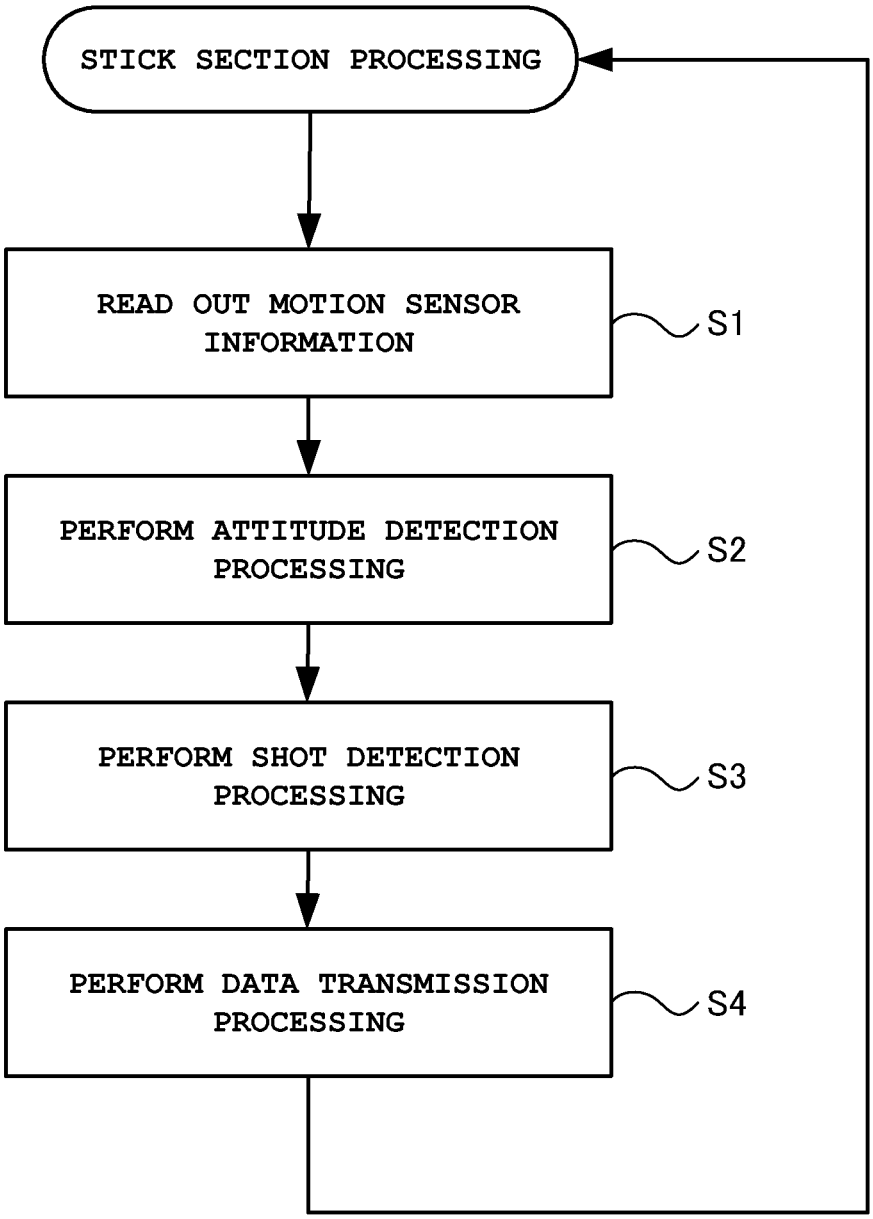
FIG. 8 is a flowchart of processing by the drumstick section.
Figure 9:
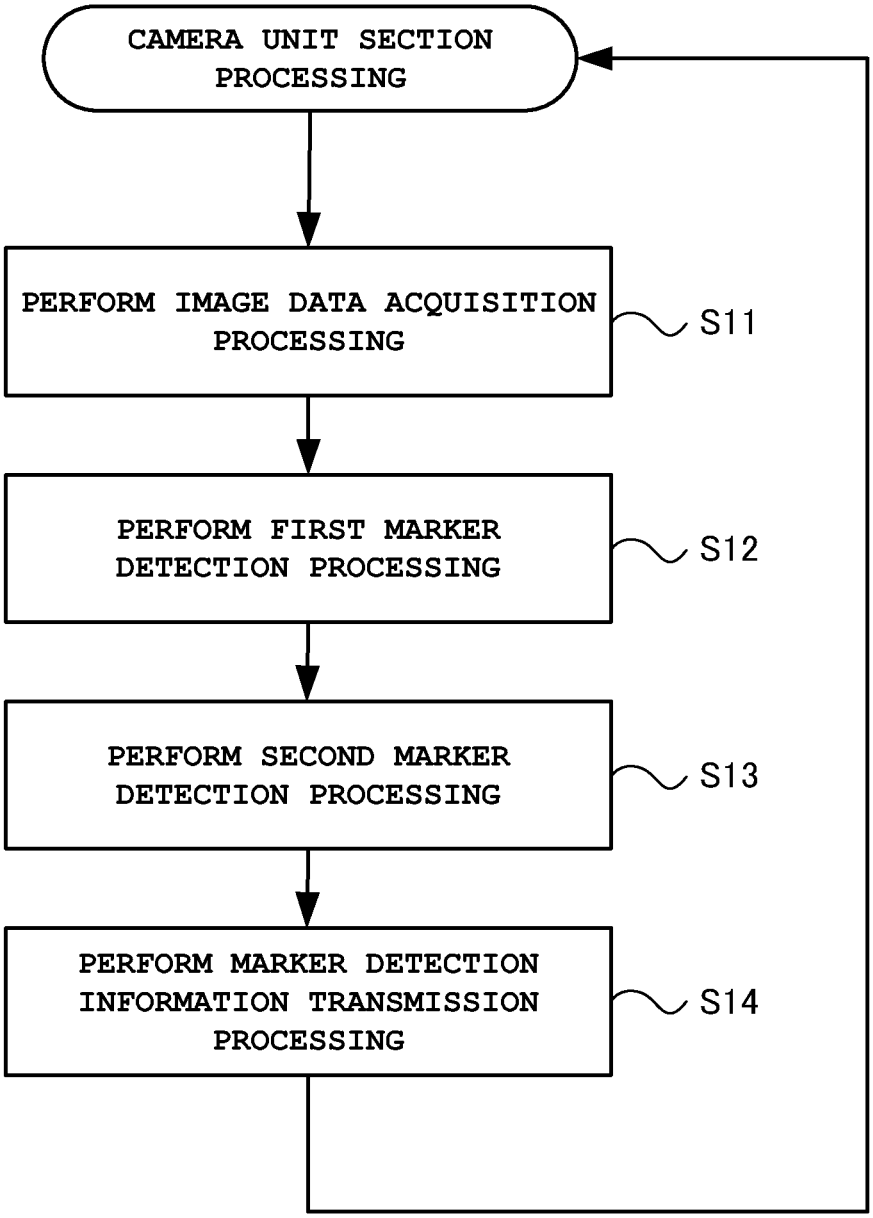

FIG. 8 is a flowchart of processing that is performed by the drumstick section 10 (hereinafter referred to as "drumstick section processing").

As shown in FIG. 8, the CPU 11 of the drumstick section 10 first reads out motion sensor information from the motion sensor section 14, or in other words, the CPU 11 of the drumstick section 10 reads out sensor values outputted by the various sensors, and stores the sensor values in the RAM 13 (Step S1). Subsequently, the CPU 11 performs attitude detection processing for the drumstick section 10 based on the read out motion sensor information (Step S2). In the attitude detection processing, the CPU 11 calculates the attitude of the drumstick section 10, such as information regarding the striking movement of the drumstick section 10 and the roll angle, based on the motion sensor information.

Then, the CPU 11 performs shot detection processing based on the motion sensor information (Step S3). Here, when playing music using the drumstick section 10, the instrument player generally performs a playing movement that is similar to the motion of striking an actual musical instrument (such as a drum). In this playing movement, the instrument player first swings the drumstick section 10 upwards and then swings it downward toward the virtual musical instrument. Subsequently, the instrument player applies force to stop the movement of the drumstick section 10 immediately before the drumstick section 10 strikes the virtual musical instrument. At this time, the instrument player is expecting the musical sound to be emitted at the instant the drumstick section 10 strikes the virtual musical instrument. Therefore, it is preferable that the musical sound is emitted at a timing expected by the instrument player. Accordingly, in the present embodiment, a musical sound is emitted at the instant the surface of the virtual musical instrument is struck by the instrument player with the drumstick section 10, or at timing slightly prior thereto.

In the present embodiment, the timing of shot detection denotes a time immediately before the drumstick section 10 stops after being swung downwards, at which the acceleration of the drumstick section 10 in the direction opposite to the downward swing direction exceeds a certain threshold value.

When judged that the shot detection timing serving as a sound generation timing has come, the CPU 11 of the drumstick section 10 generates a note-ON event and transmits it to the center unit section 30. As a result, sound emission processing is performed by the center unit section 30 and the musical sound is emitted.

In the shot detection processing at Step S3, the CPU 11 generates a note-ON event based on the motion sensor information (such as a sensor resultant value of the acceleration sensor). The note-ON event to be generated herein may include the volume of a musical sound to be emitted, which can be determined from, for example, the maximum value of the sensor resultant value.

Next, the CPU 11 transmits information detected by the processing at Step S2 and Step S3, or in other words, attitude information and shot information to the center unit section 30 via the data communication section 16 (Step S4). When transmitting, the CPU 11 associates the attitude information and the shot information with the drumstick identification information, and then transmits them to the center unit section 30.

Then, the CPU 11 returns to the processing at Step S1 and repeats the subsequent processing.

[Processing by the Camera Unit Section 20]

Figure 9:
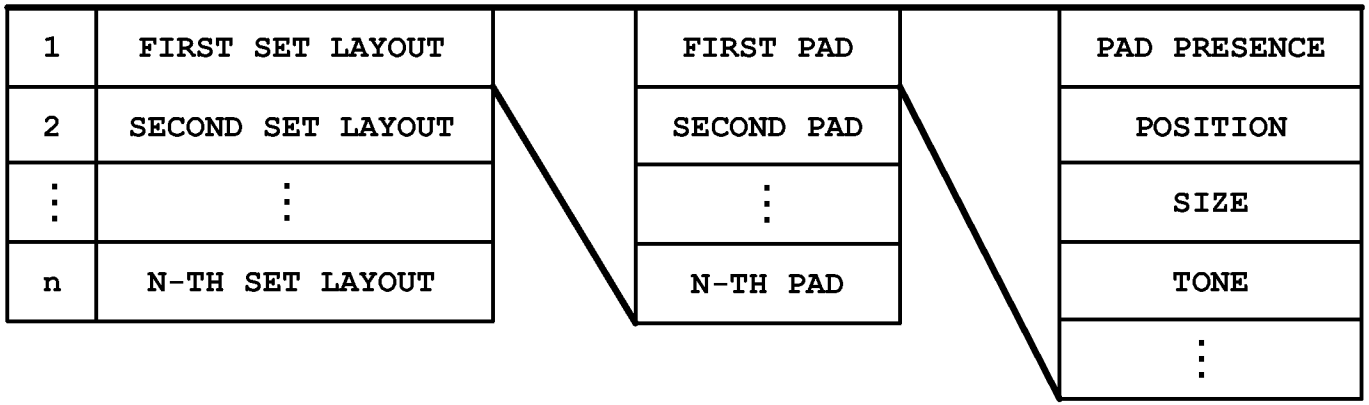
FIG. 9 is a flowchart of processing by the camera unit section.

FIG. 9 is a flowchart of processing that is performed by the camera unit section 20 (hereinafter referred to as "camera unit section processing").

As shown in FIG. 9, the CPU 21 of the camera unit section 20 first performs image data acquisition processing (Step S11). In the image data acquisition processing, the CPU 21 acquires image data from the image sensor section 24.

Next, the CPU 21 performs first marker detection processing (Step S12) and second marker detection processing (Step S13). In the first marker detection processing and the second marker detection processing, the CPU 21 acquires the marker detection information of the marker section 15 (first marker) of the drumstick section 10A and the marker detection information of the marker section 15 (second marker) of the drumstick section 10B which include the position coordinates, the sizes, and the angles thereof and have been detected by the image sensor section 24, and stores the marker detection information in the RAM 23. Note that the image sensor section 24 detects the marker detection information of the lighted marker section 15.

Then, the CPU 21 transmits the marker detection information acquired at Step S12 and Step S13 to the center unit section 30 via the data communication section 25 (Step S14), and returns to the processing at Step S11.

[Processing by the Center Unit Section 30]

Figure 10:
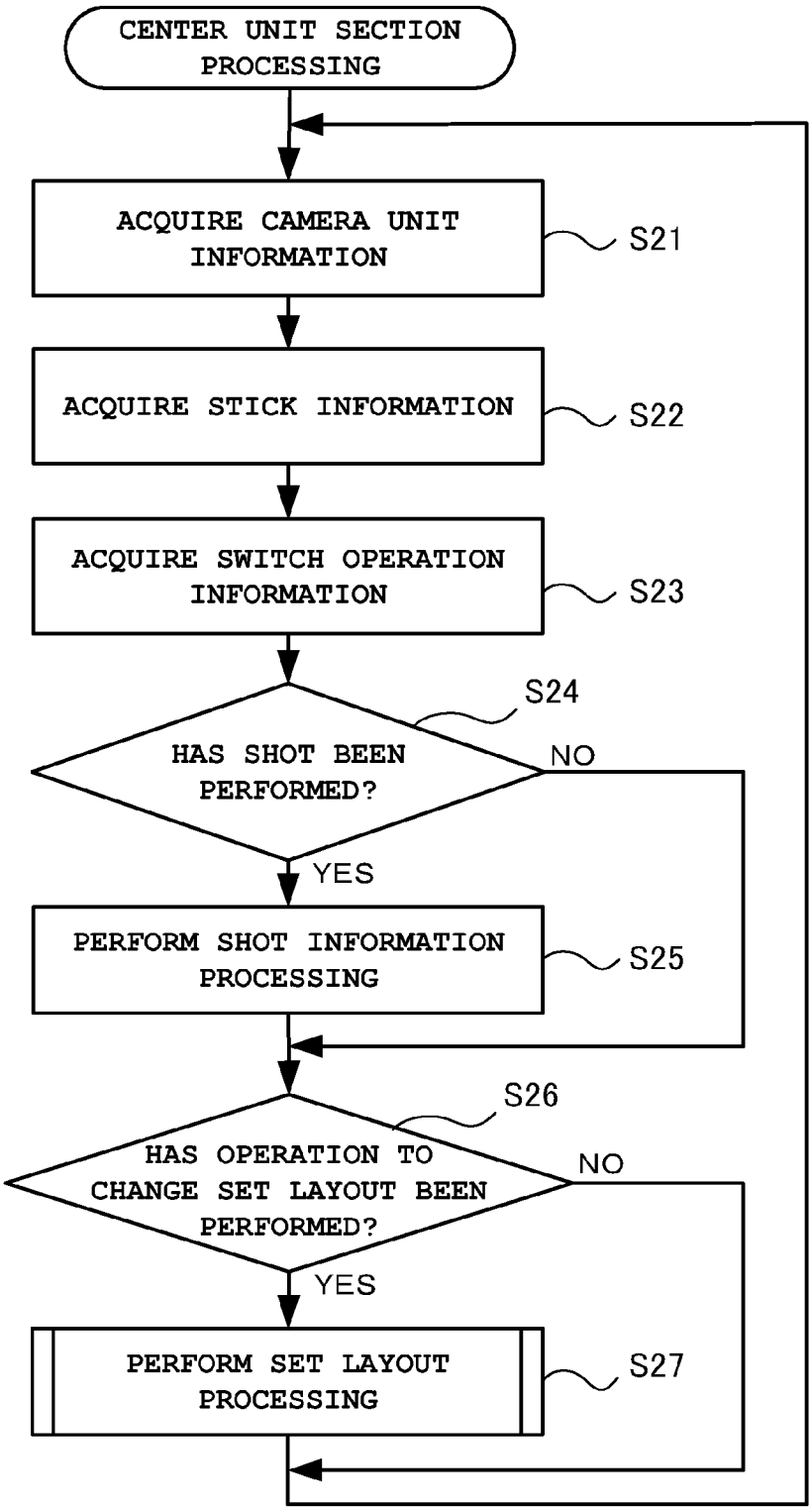
FIG. 10 is a flowchart of processing by the center unit section.

FIG. 10 is a flowchart of processing that is performed by the center unit section 30 (hereinafter referred to as "center unit section processing").

As shown in FIG. 10, the CPU 31 of the center unit section 30 first receives the marker detection information of the first maker and the second marker from the camera unit section 20, and stores them in the RAM 33 (Step S21). In addition, the CPU 31 receives attitude information and shot information associated with drumstick identification information from each of the drumstick sections 10A and 10B, and stores them in the RAM 33 (Step 822). Moreover, the CPU 31 acquires information inputted by the operation of the switch 341 (Step S23).

Next, the CPU 31 judges whether a shot has been performed (Step S24). In this processing, the CPU 31 judges whether a shot has been performed by judging whether a note-ON event has been received from the drumstick section 10. When judged that a shot has been performed, the CPU 31 performs shot information processing (Step S25). In the shot information processing, the CPU 31 reads out musical tone data (waveform data) associated with a virtual pad 81 in an area where position coordinates included in the marker detection information are located, from set layout information read out into the RAM 33, and outputs the musical tone data and sound volume data included in the note-ON event to the sound source device 36. Then, the sound source device 36 emits the corresponding musical sound based on the received waveform data.

After Step S25 or when a judgment result at Step S24 is NO, the CPU 31 judges whether an operation to change the current set layout has been performed (Step S26). In this processing, when the position coordinates of the marker section 15 at the time of shot detection are within the area corresponding to the control pad 91, the CPU 31 judges that an operation to change the current set layout has been performed. When judged that an operation to change the set layout has been performed, the CPU 31 performs set layout processing (Step S27), and then returns to the processing at Step S21. Conversely, when judged that an operation to change the set layout has not been performed, the CPU 31 returns to the processing at Step S21 without performing any processing.

[Set Layout Processing by the Center Unit Section 30]

Figure 11:
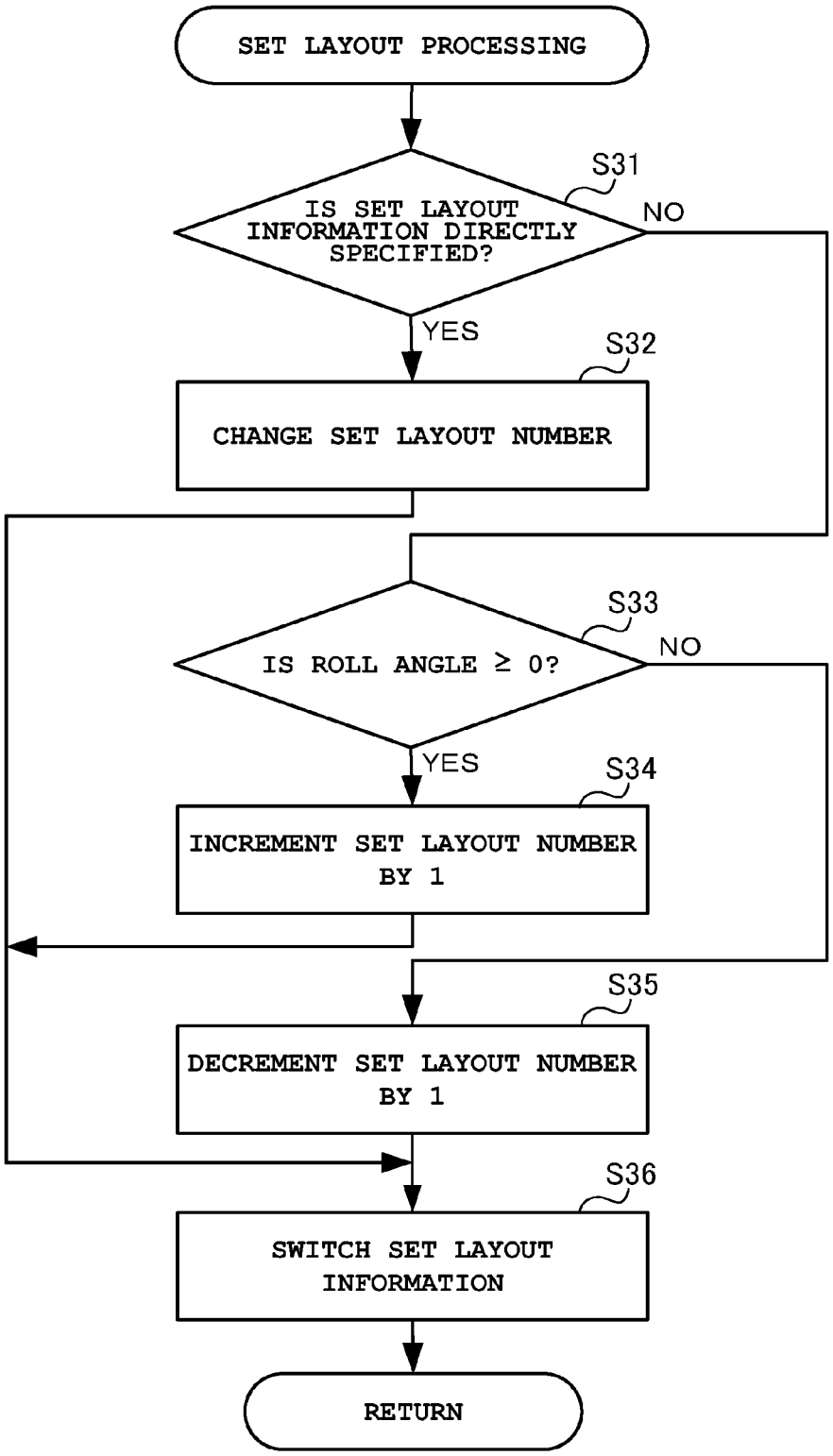
FIG. 11 is a flowchart of set layout processing by the center unit section.

FIG. 11 is a flowchart showing a detailed flow of the set layout processing at Step S27 in the center unit section processing in FIG. 10.

As shown in FIG. 11, the CPU 31 first judges whether set layout information is directly specified (Step S31). Specifically, the CPU 31 judges whether signal information serving as a trigger to directly specify set layout information has been received from the drumstick section 10. When judged that set layout information is directly specified, the CPU 31 changes the current set layout number (Step S32). When judged that set layout information is not directly specified, the CPU 31 proceeds to the processing at Step S33.

The change of the set layout number at Step S32 is made by the CPU 31 reading out set layout information from the ROM 32 into the RAM 33 based on a set layout number set in the RAM 33 by the operation of the switch 341.

On the other hand, at Step S33, the CPU 31 judges whether the roll angle is equal to or more than 0 (Step S33). In this processing, the CPU 31 judges whether a roll angle included in the attitude information received from the drumstick section 10 is equal to or more than 0. Here, roll angles equal to or more than 0 indicate a state where the instrument player has rotated the drumstick section 10 around its axis to the right from a reference position, and roll angles less than 0 indicate a state where the instrument player has rotated the drumstick section 10 around its axis to the left from the reference position (see FIG. 13). When judged that the roll angle is equal to or more than 0, the CPU 31 increments the current set layout number by 1 (Step S34) and proceeds to the processing at Step S36. Conversely, when judged that the roll angle is less than 0, the CPU 31 decrements the current set layout number by 1 (Step S35) and proceeds to the processing at Step S36.

Next, the CPU 31 switches the current set layout information (Step S36) In this processing, the CPU 31 reads out set layout information corresponding to the set layout number determined at Step S32, Step S34, or Step S35 into the RAM 33, from the set layout information group stored in the ROM 32.

[Examples of Changes in set Layout Information]

Figure 12:
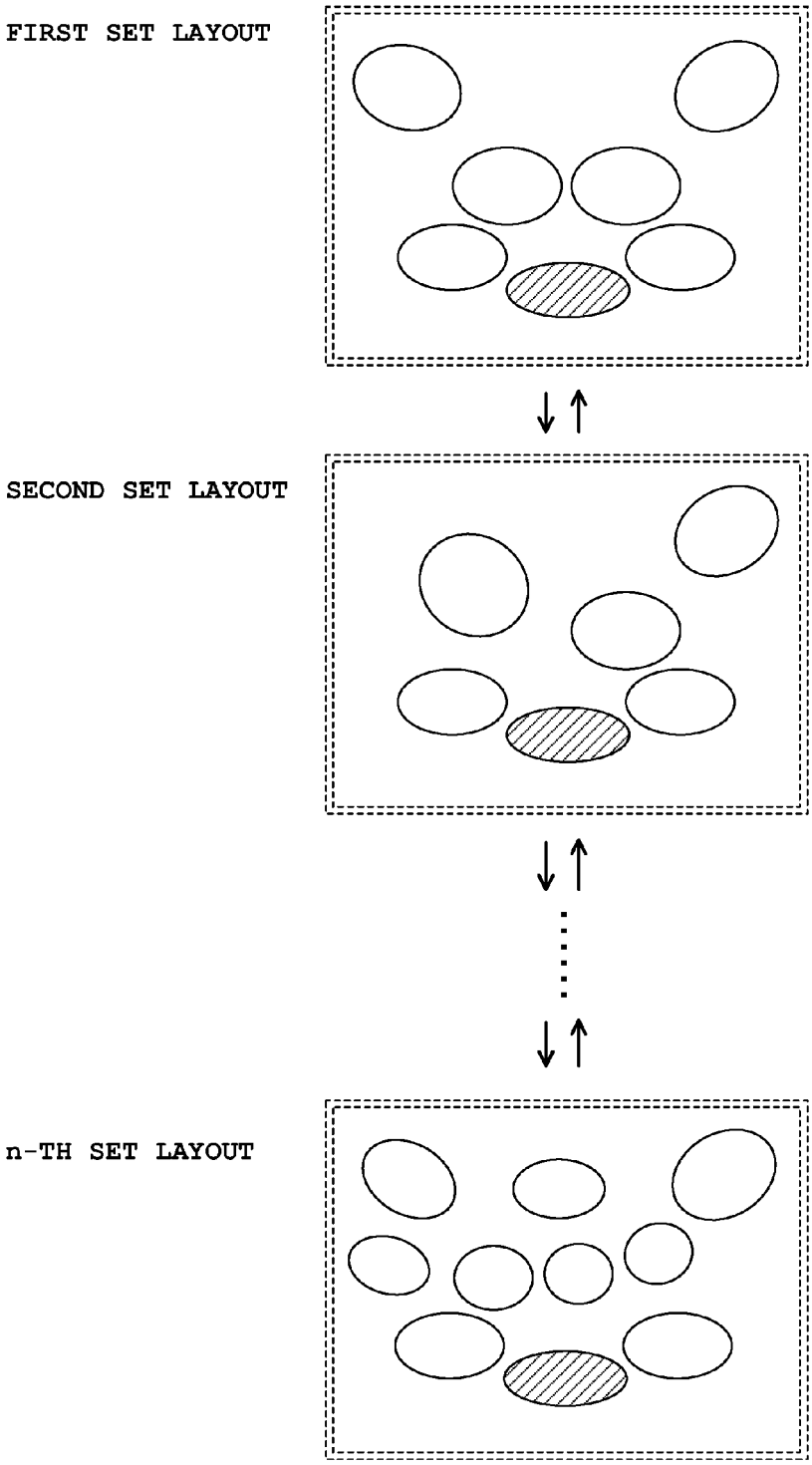
FIG. 12 is a diagram showing variation examples of the set layout information.

Examples of changes in set layout information will be described with reference to FIG. 12. In FIG. 12, the first set layout to the n-th set layout are shown as set layout information. When the control pad 91 is struck, set layout information is changed based on the roll angle, as described with reference to FIG. 10 and FIG. 11.

For example, when the instrument player strikes the control pad 91 with the drumstick section 10 rotated around the axis to the right from the reference position, the current set layout information is changed to that corresponding to the next set layout number. Also, when the instrument player strikes the control pad 91 with the drumstick section 10 rotated to the left, the current set layout information is changed to that corresponding to the preceding set layout number. Moreover, when the instrument player strikes the control pad 91 while pressing the switch 171 of the drumstick section 10, the current set layout information is changed to that corresponding to a set layout number manually set in the RAM 33.

The structure and processing of the musical performance device 1 according to the present embodiment are as described above.

In the present embodiment, the CPU 31 identifies a musical tone associated with a virtual pad 81 in an area where the position coordinates of the marker section 15 are located in an image captured by the camera unit section 20 at a shot timing by the stick section 10, and emits the identified musical tone. When the position coordinates of the marker section 15 in an image captured at a shot timing are within the area of the control pad 91 on a virtual plane, the CPU 31 switches processing target set layout information to other set layout information among a plurality of set layout information.

As a result of this configuration, the instrument player can change set layout information by striking the control pad 91, and thereby can quickly and easily switch among a variety of drum sets. Therefore, musical performance that is not possible with an ordinary drum set can be actualized.

Also, in the present embodiment, the CPU 31 switches processing target set layout information to other set layout information based on the roll angle of the drumstick section 10 at a shot timing for the control pad 91.

Therefore, the instrument player can select desired set layout information by adjusting a roll angle that is a rotation angle around the axis of the drumstick section 10 when striking the control pad 91.

Moreover, in the present embodiment, when the roll angle of the drumstick section 10 at a shot timing for the control pad 91 is equal to or more than 0, the CPU 31 increments the current set layout number by 1. When the roll angle is less than 0, the CPU 31 decrements the current set layout number by 1. Then, the CPU 31 switches the set layout information to that corresponding to the incremented or decremented set layout number.

That is, by twisting the drumstick section 10 to the right when striking the control pad 91, the instrument player can increment the current set layout number by 1. In addition, by twisting the drumstick section 10 to the left, the instrument player can decrement the current set layout number by 1. As a result of this configuration, the instrument player can easily select desired set layout information during musical performance. In addition, even if the control pad 91 is mistakenly struck and the current set layout information is changed thereby, the instrument player can easily switch it back to the previous set layout information. Note that, although a configuration has been described in which a roll angle is associated with a set layout, a configuration may be adopted in which a detected roll angle is also used to change other control parameters, such as a musical tone.

In addition, although the above-described embodiment has been described using the virtual drum set D (see FIG. 1) as a virtual percussion instrument, the present invention is not limited thereto, and may be applied to other musical instruments such as a xylophone which emit musical sound by a downward swing movement of the drumstick section 10.

Moreover, among the processing performed by the drumstick section 10, the camera unit section 20, and the center unit section 30 in the above-described embodiment, arbitrary processing may be performed by a different unit (the drumstick section 10, the camera unit section 20, or the center unit section 30). For example, processing such as shot detection and roll angle calculation which is performed by the CPU 11 of the drumstick section 10 may be performed by the center unit section 30.

Furthermore, in the above-described embodiment, when the control pad 91 is struck with the switch 171 of the drumstick section 10 being pressed, set layout information corresponding to a set layout number manually set in the RAM 33 of the center unit section 30 is read out from the ROM 32. However, a configuration may be adopted in which set layout information is read out from the ROM 32 not only when the control pad 91 is struck, but also when another virtual pad 81 is struck.

While the present invention has been described with reference to the preferred embodiments, it is intended that the invention be not limited by any of the details of the description therein but includes all the embodiments which fall within the scope of the appended claims.

What is claimed is:

1. A musical performance device comprising:

a musical performance component which is operated by a player;

a position detecting section which detects a position of the musical performance component on a virtual plane where the musical performance component is operated;

a selecting section which selects layout information from among plural types of layout information including a plurality of areas arranged on the virtual plane and musical tones respectively associated with the plurality of areas;

a judging section which judges whether the position of the musical performance component is within one of the plurality of areas arranged based on currently-selected layout information selected by the selecting section, when a certain music-playing operation is performed by the musical performance component; and a sound generation instructing section which, when the judging section judges that the position of the musical performance component is within one area of the plurality of areas, gives an instruction to emit a musical sound of a musical tone associated with the one area, wherein the plural types of layout information respectively include information regarding a predetermined area other than the plurality of areas, and wherein the selecting section selects layout information other than the currently-selected layout information from among the plural types of layout information, when the certain music-playing operation is performed by the musical performance component and the position of the musical performance component is within the predetermined area.

2. The musical performance device according to claim 1, wherein the musical performance component comprises a roll angle detecting section which detects a roll angle of the musical performance component, and wherein the selecting section determines other layout information to be selected from among the plural types of layout information, based on the roll angle detected by the roll angle detecting section when the certain music-playing operation is performed by the musical performance component.

3. The musical performance device according to claim 2, wherein the plural types of layout information are each provided with a different layout number; and wherein the selecting section changes the layout number by incrementing the layout number by a predetermined number when the detected roll angle is within a first predetermined range, and decrementing the layout number by a predetermined number when the detected roll angle is within a second predetermined range, and selects layout information provided with the changed layout number as the other layout information.

4. A non-transitory computer-readable storage medium having stored thereon a program that is executable by a computer of a musical performance device including a musical performance component which is operated by a player and a position detecting section which detects a position of the musical performance component on a virtual plane where the musical performance component is operated, wherein the musical performance device is operable with respect to plural types of layout information including a plurality of areas arranged on the virtual plane and musical tones respectively associated with the plurality of areas, wherein the plural types of layout information respectively include information regarding a predetermined area other than the plurality of areas, and wherein the program is executable by the computer to perform functions comprising:

selecting layout information other than currently-selected layout information from among the plural types of layout information, when a certain music-playing operation is performed by the musical performance component and the position of the musical performance component is within the predetermined area;

judging whether the position of the musical performance component is within one of the plurality of areas arranged based on the selected layout information, when the certain music-playing operation is performed by the musical performance component; and when the position of the musical performance component is judged to be within one area of the plurality of areas, giving an instruction to emit musical sound of a musical tone associated with the one area.

5. A method for controlling a musical performance device including a musical performance component which is operated by a player and a position detecting section which detects a position of the musical performance component on a virtual plane where the musical performance component is operated, wherein the musical performance component is operable with respect to plural types of layout information including a plurality of areas arranged on the virtual plane and musical tones respectively associated with the plurality of areas, wherein the plural types of layout information respectively include information regarding a predetermined area other than the plurality of areas, and wherein the method comprises:

selecting layout information other than currently-selected layout information from among the plural types of layout information, when a certain music-playing operation is performed by the musical performance component and the position of the musical performance component is within the predetermined area;

judging whether the position of the musical performance component is within one of the plurality of areas arranged based on the selected layout information, when the certain music-playing operation is performed by the musical performance component; and giving an instruction to, when the position of the musical performance component is judged to be within one area of the plurality of areas, emit musical sound of a musical tone associated with the one area.

* * * * *